US006577285B1

(12) United States Patent
Motonakano et al.

(10) Patent No.: US 6,577,285 B1
(45) Date of Patent: Jun. 10, 2003

(54) GAMMA CORRECTOR AND IMAGE DISPLAY DEVICE USING THE SAME

(75) Inventors: Hitoshi Motonakano, Kagoshima (JP); Shozo Mitarai, Kagoshima (JP)

(73) Assignee: Sony Corporation (JP)

( * ) Notice: Subject to any disclaimer, the term of this patent is extended or adjusted under 35 U.S.C. 154(b) by 0 days.

(21) Appl. No.: 09/417,546

(22) Filed: Oct. 14, 1999

(30) Foreign Application Priority Data

Oct. 21, 1998 (JP) ..... 10-300112

(51) Int. Cl.[7] ..... G09G 5/00

(52) U.S. Cl. ..... 345/10; 345/690; 345/204; 345/11; 345/12; 345/13; 348/674; 348/675; 358/518; 358/519

(58) Field of Search ..... 345/589, 204, 345/690, 12, 10, 13, 20, 11; 348/674, 675; 358/518, 519

(56) References Cited

U.S. PATENT DOCUMENTS 4,651,210 A * 3/1987 Olson ..... 327/317
4,847,524 A * 7/1989 Van Rooy et al. ..... 327/563
5,461,430 A * 10/1995 Hagerman ..... 348/674
5,483,256 A * 1/1996 Ohi ..... 345/98
5,526,058 A * 6/1996 Sano et al. ..... 327/350
5,610,666 A * 3/1997 Ueda et al. ..... 348/674
5,754,150 A * 5/1998 Matsui ..... 345/207
5,933,199 A * 8/1999 Yoon ..... 348/254

* cited by examiner

*Primary Examiner*—Jeffery Brier
*Assistant Examiner*—Daniel J Chung
(74) *Attorney, Agent, or Firm*—Rader, Fishman & Grauer PLLC; Ronald P. Kananen, Esq.

(57) ABSTRACT

A gamma corrector inputs a primary color signal as an image signal to each of the differential amplifiers which are connected in parallel to each other and mixes a plurality of output signals which are outputted from the four differential amplifiers to output an image signal to which a plurality of gamma correction is applied. Each of the differential amplifiers amplifies and outputs the inputted primary color signal with a different gain characteristic so that the gain characteristic of the signal obtained by mixing the output signals varies at two inflection points. The two-point gamma correction is applied to the inputted primary color signal so that a signal level at the side of a black level is turned down and the signal level at the side of a white level is turned up.

10 Claims, 5 Drawing Sheets

GAMMA CORRECTOR AND IMAGE DISPLAY DEVICE USING THE SAME

BACKGROUND OF THE INVENTION

1. Field of the Invention

The present invention relates to a gamma corrector which applies gamma correction to an image signal and an image display device such as a display device for a computer.

2. Description of the Related Art

FIG. 1 is a schematic block diagram showing a structure of a display device of the related art for a computer. The display device shown in FIG. 1 for a computer includes an image signal processing circuit 101, a deflection processing circuit 102 and a cathode ray tube 103 (called CRT in the followings). An image signal consisting of color signals $S_R$, $S_G$ and $S_B$ (these three primary color signals are collectively called signal $S_i$ in the followings) of red (R), green (G) and blue (B), respectively, is inputted into the image signal processing circuit 101. A horizontal sync signal, $S_h$, and a vertical sync signal, $S_v$, are inputted into the deflection processing circuit 102. An output signal from the image signal processing circuit 101 and an output signal from the deflection processing circuit 102 are inputted into the CRT 103. The CRT 103 has an electron gun which includes cathodes for each color, R, G and B, and a deflection yoke for deflecting an electron beam emitted from the cathode to the vertical and horizontal directions (both the electron gun and the deflection yoke are not shown).

The image signal processing circuit 101 includes a preamplifier 105 and a main amplifier 106. The preamplifier 105 amplifies and outputs the inputted signal $S_i$, and the main amplifier 106 further amplifies and outputs the output from the preamplifier 105. The preamplifier 105 and the main amplifier 106 are equipped with a separate circuit, not shown, for each of color signals $S_R$, $S_G$ and $S_B$ of R, G and B, respectively. The deflection processing circuit 102 controls field generation caused by the deflection yoke, not shown, in the CRT 103 and deflects the electron beam emitted from the electron gun, not shown, to the vertical or horizontal direction, based on the inputted horizontal and vertical sync signals ($S_h$ and $S_v$.)

The display device is able to display an image as follows. The CRT 103 generates an electron beam based on the output signals from the image signal processing circuit 101 and the deflection processing circuit 102 and then irradiates the generated electron beam on a fluorescent surface, not shown, to display an image.

The display device such as the above-described display device for a computer also usually includes a gamma corrector for correcting brightness of the image displayed on the CRT 103. The gamma corrector may be placed in front of the preamplifier 105 in the image signal processing circuit 101. The gamma corrector for the display device of the related art for a computer performs the one-point gamma correction, where a gain of an input/output characteristic of the image signal is varied at one point, which generally corresponds to an intermediate brightness. However, during the one-point gamma correction, when the signal level of the intermediate brightness at one point to be varied is turned up, the signal levels at other points which should not be varied, a signal level corresponding to gray, for example, is also turned up to some extent. This causes deterioration of image quality; a dark part in an image appears unclear, for example.

On the other hand, the gamma corrector in a display device for a television performs the gamma correction in which an input/output characteristic of an image signal traces a quadric curve, for example. However, the gamma corrector, whereby the input/output characteristic traces the quadric curve, requires considerable numbers of elements in the circuit and thus a frequency characteristic deteriorates due to a parasitic capacity caused by using a PNP transistor. In addition, the display device for a computer usually includes an image signal with a higher frequency (at least 100 MHz, for example) than that in the display device for a television. Thus, the gamma correction with the quadric curve cannot provide the sufficient frequency characteristic required for the display device for a computer, which deals with an image signal with a high frequency.

SUMMARY OF THE INVENTION

The invention is presented to solve these problems. An object of the invention is to provide a gamma corrector and an image display device that can perform the optimum gamma correction for an image display device such as a display device for a computer.

A gamma corrector according to the present invention inputs an image signal to a plurality of differential amplifiers which are connected in parallel each other and mixes a plurality of output signals which are outputted from the differential amplifiers to output an image signal to which the gamma correction is applied, each of the differential amplifiers amplifying and outputting the inputted image signal with a different gain characteristic so that the gain characteristic of the signal obtained by mixing the output signals varies at two inflection points.

An image display device according to the present invention comprises a gamma corrector which inputs an image signal to a plurality of differential amplifiers which are connected in parallel to each other and mixes a plurality of output signals which are outputted from the differential amplifiers to output an image signal to which the gamma correction is applied, wherein each of the differential amplifiers amplifies and outputs the inputted image signal with a different gain characteristic so that the gain characteristic of the signal obtained by mixing the output signals varies at two inflection points.

In a gamma corrector or an image display device of the present invention, each of the differential amplifiers amplifies and outputs an input image signal with a different gain characteristic so that the gain characteristic of the signal obtained by mixing the signals outputted from the differential amplifiers varies at two inflection points.

Other and further objects, features and advantages of the invention will appear more fully from the following description.

DETAILED DESCRIPTION OF THE PREFERRED EMBODIMENT

An embodiment of the invention will be described with reference to the drawings in the followings.

Figure 1:
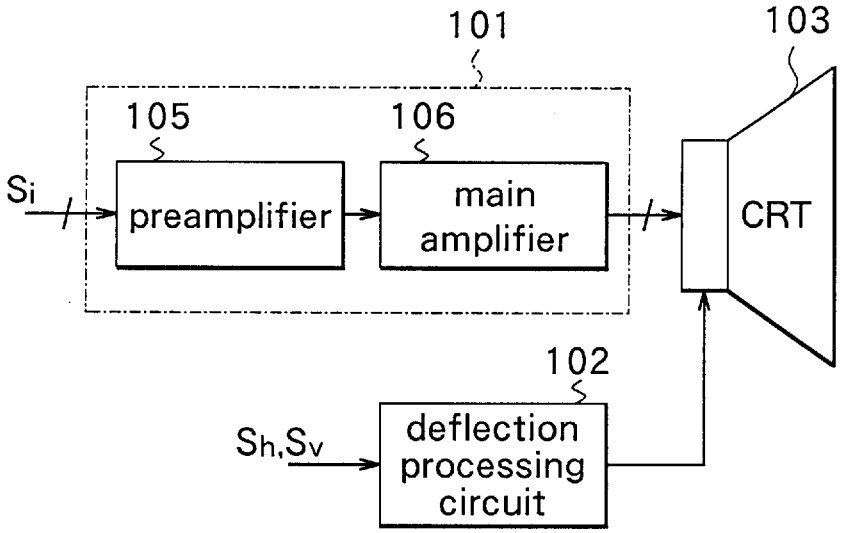
FIG.1 RELATED ART
FIG. 1 is a block diagram showing a schematic structure of a display device of the related art for a computer.
Figure 2:
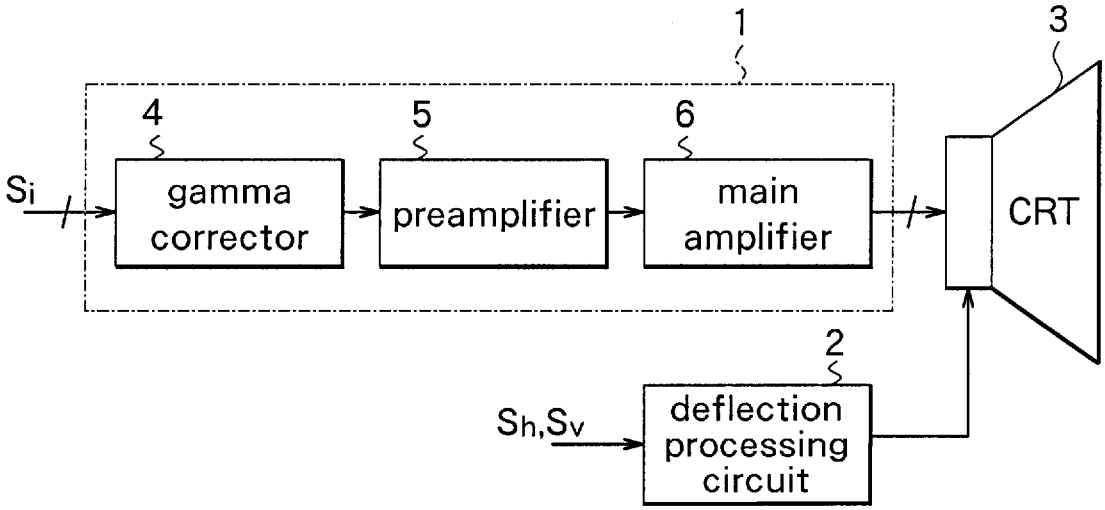
FIG. 2 is a block diagram showing an example of a structure of a display device including a gamma corrector according to an embodiment of the present invention.

FIG. 2 is a block diagram showing an example of a structure of a display device including a gamma corrector according to an embodiment of the present invention. The display device shown in FIG. 2 is used as a display device for a computer, for example. The display device shown in FIG. 2 includes an image signal processing circuit 1, a deflection processing circuit 2 and a CRT 3. An image signal consisting of signal $S_i$ (three primary color signals $S_R$, $S_G$ and $S_B$) of R, G and B is inputted into the image signal processing circuit 1. A horizontal sync signal, $S_h$, and a vertical sync signal, $S_v$, are inputted to the deflection processing circuit 2. An output signal from the image signal processing circuit 1 and an output signal from the deflection processing circuit 2 are inputted to the CRT 3. The CRT 3 has an electron gun which includes a cathode for each color, R, G and B, and a deflection yoke for deflecting an electron beam emitted from the cathode to the vertical and horizontal directions (both the electron gun and the deflection yoke are not shown).

The image signal processing circuit 1 is a circuit which controls a contrast of light intensity between black and white, brightness of a picture, and so on. The image signal processing circuit 1 includes a gamma corrector 4, a preamplifier 5 and a main amplifier 6. The signal $S_i$ is inputted to the gamma corrector 4, and the gamma corrector 4 applies gamma correction to the signal $S_i$. The preamplifier 5 amplifies and outputs the signal outputted from the gamma corrector 4. The main amplifier 6 further amplifies and outputs the signal outputted from the preamplifier 5. The gamma corrector 4, the preamplifier 5 and the main amplifier 6 are equipped with a separate circuit, not shown, for each of color signals, $S_R$, $S_G$ and $S_B$ of R, G and B respectively.

The deflection processing circuit 2 controls field generation caused by the deflection yoke, not shown, in the CRT 103 and deflects the electron beam emitted from the electron gun, not shown, to the horizontal and vertical directions, based on the inputted horizontal and vertical sync signals ($S_h$ and $S_v$.) The CRT 3 generates an electron beam based on the output signals from the image signal processing circuit 1 and the deflection processing circuit 2 and then irradiates the generated electron beam on a fluorescent surface, not shown, to display an image.

Figure 3:
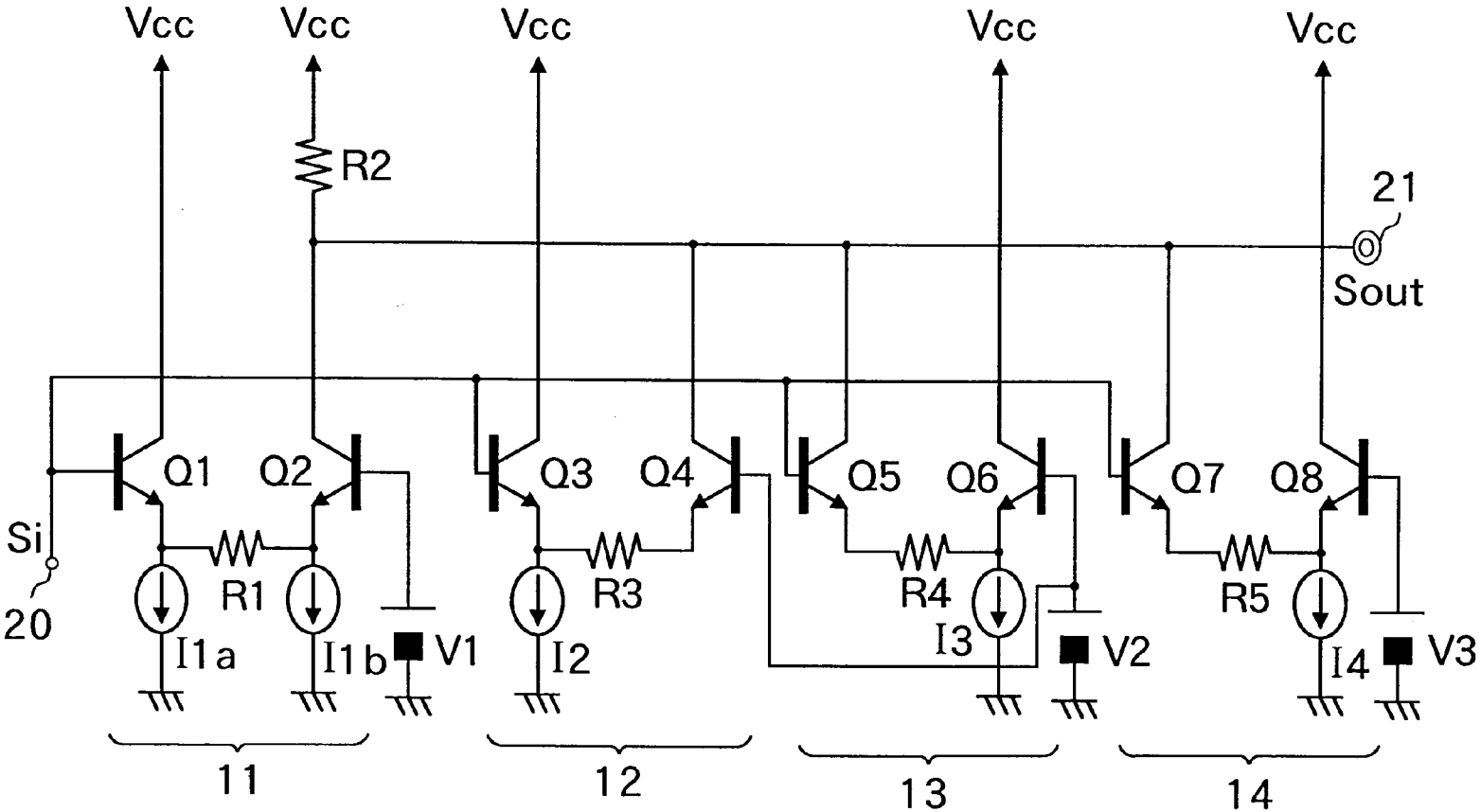
FIG. 3 is a circuit diagram showing a detailed structure of the gamma corrector in the display device shown in FIG. 2.

FIG. 3 is a circuit diagram showing a detailed structure of the gamma corrector 4 shown in FIG. 2.

As shown in FIG. 3, the gamma corrector 4 includes a plurality of differential amplifiers 11, 12, 13 and 14, which are connected in parallel, and a load resistance element R2. The differential amplifier 11 has transistors Q1 and Q2, a resistance element R1 and constant current sources I1*a* and I1*b*. The differential amplifier 12 has transistors Q3 and Q4, a resistance element R3 and a constant current source I2. The differential amplifier 13 has transistors Q5 and Q6, a resistance element R4 and a constant current source 13. The differential amplifier 14 has transistors Q7 and Q8, a resistance element R5 and a constant current source I4. The amplification factor for each of the differential amplifiers 11, 12, 13 and 14 can be controlled by a resistant value of the resistance elements R1, R3, R4 and R5 respectively. The differential amplifiers 11, 12, 13 and 14 correspond to a first, a second, a third and fourth differential amplifiers of the present invention, respectively.

In the differential amplifier 11, an emitter of the transistor Q1 and an emitter of the transistor Q2 are connected to each other through the resistance element R1. The emitter of the transistor Q1 is connected to the constant current source I1*a* whose one end is grounded. The emitter of the transistor Q2 is also connected to the constant current source I1*b* whose one end is grounded. A base of the transistor Q1 is connected to an input terminal 20 to which the signal $S_i$ is inputted. A base of the transistor Q2 is connected to a constant voltage source V1 which generates a reference voltage, V1, in the differential amplifier 11. One end of the constant voltage source V1 is grounded. A collector of the transistor Q1 is connected to a source voltage Vcc. A collector of the transistor Q2 is connected to the source voltage Vcc, not shown, through the load resistance element R2. The collector of the transistor Q2 is also connected to an output terminal 21 of the gamma corrector 4.

In the differential amplifier 12, an emitter of the transistor Q3 and an emitter of the transistor Q4 are connected to each other through the resistance element R3. The emitter of the Q3 is also connected to the constant current source 12 whose one end is grounded. A base of the transistor Q3 is connected to the input terminal 20 to which the signal $S_i$ is inputted. A base of the transistor Q4 is connected to a constant voltage source V2 which generates a reference voltage, V2. One end of the constant voltage source V2 is grounded. A collector of the transistor Q3 is connected to the source voltage Vcc. A collector of the transistor Q4 is connected to the source voltage Vcc through the load resistance element R2. The collector of the transistor Q4 is also connected to the output terminal 21 of the gamma corrector 4.

In the differential amplifier 13, an emitter of the transistor Q5 and an emitter of the transistor Q6 are connected to each other through the resistance element R4. The emitter of the transistor Q6 is also connected to the constant current source I3 whose one end is grounded. A base of the transistor Q5 is connected to the input terminal 20 to which the signal $S_i$ is inputted. A base of the transistor Q6 is connected to the constant voltage source V2 which generates the reference voltage, V2. A collector of the transistor Q6 is connected to the source voltage Vcc. A collector of the transistor Q5 is connected to the source voltage Vcc through the load resistance element R2. The collector of the transistor Q5 is also connected to the output terminal 21 of the gamma corrector 4.

In the differential amplifier 14, an emitter of the transistor Q7 and an emitter of the transistor Q8 are connected to each other through the resistance element R5. The emitter of the transistor Q8 is also connected to the constant current source I4 whose one end is grounded. A base of the transistor Q7 is connected to the input terminal 20 to which the signal $S_i$ is inputted. A base of the transistor Q8 is connected to a constant voltage source V3 which generates a reference voltage, V3. A collector of the transistor Q8 is connected to the source voltage Vcc. A collector of the transistor Q7 is connected to the source voltage Vcc through the load resistance element R2. The collector of the transistor Q7 is also connected to the output terminal 21 of the gamma corrector 4.

A signal $S_{out}$ which is outputted from the output terminal 21 of the gamma corrector 4 is a signal in which output signals from the differential amplifiers 11, 12, 13 and 14 are combined.

Next, the operation of the gamma corrector 4 with the structure as described above will be explained in the followings.

Figure 6:
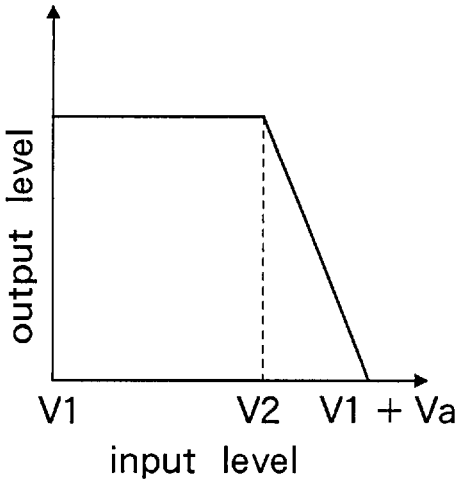
FIG. 6 is a characteristic diagram showing an input/output characteristic of a third differential amplifier in the gamma corrector shown in FIG. 3.
Figure 7:
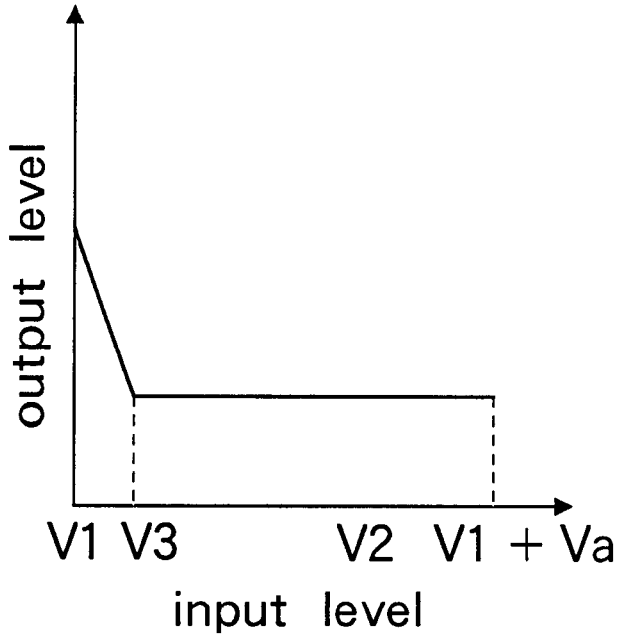
FIG. 7 is a characteristic diagram showing an input/output characteristic of a fourth differential amplifier in the gamma corrector shown in FIG. 3.
Figure 8:
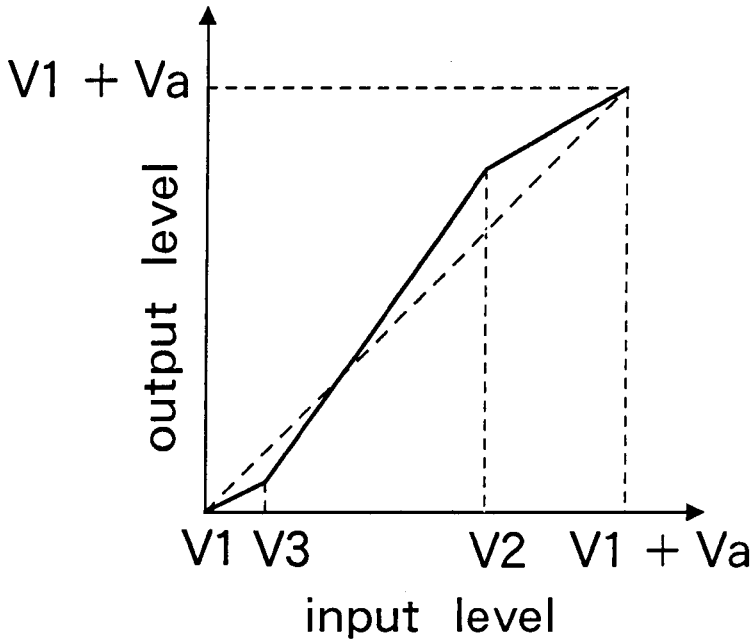
FIG. 8 is a characteristic diagram showing a composite input/output characteristic of the gamma corrector shown in FIG. 3.

FIGS. 4–8 are characteristic diagrams showing an input/output characteristic of a signal in the gamma corrector 4. FIGS. 4–7 are characteristic diagrams showing an input/output characteristic of a signal in the differential amplifiers 11–14. FIG. 8 is a characteristic diagram showing an input/output characteristic of a composite signal in the gamma corrector 4 shown in FIG. 3. In these characteristic diagrams, the horizontal axis indicates a level of an input signal, and the vertical axis indicates a level of an output signal. These diagrams also show the case when the signal level of the signal $S_i$ inputted from the input terminal 20 is between V1 and V1+Va (Va is a signal amplitude). In these diagrams, a lower output level corresponds to a black level, and a higher output level to a white level.

In the gamma corrector 4, the signal $S_i$ is inputted to the bases of the transistors Q1, Q3, Q5 and Q7 in the differential amplifiers 11, 12, 13 and 14 respectively, and the output signals from the collectors of the transistors Q2, Q4, Q5 and Q7 in the differential amplifiers 11, 12, 13 and 14 respectively are mixed. The mixed signal $S_{out}$ is outputted from the output terminal 21.

Figure 4:
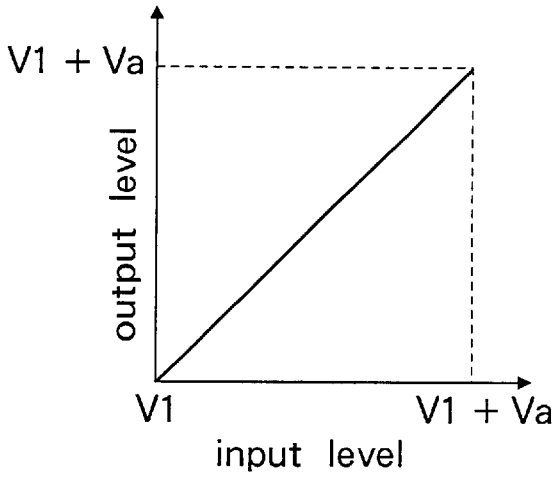
FIG. 4 is a characteristic diagram showing an input/output characteristic of a first differential amplifier in the gamma corrector shown in FIG. 3.

The input/output characteristic of the signal in the differential amplifier 11 has the gain of 0 dB in the signal level range from V1 to V1+Va, as shown in FIG. 4.

Figure 5:
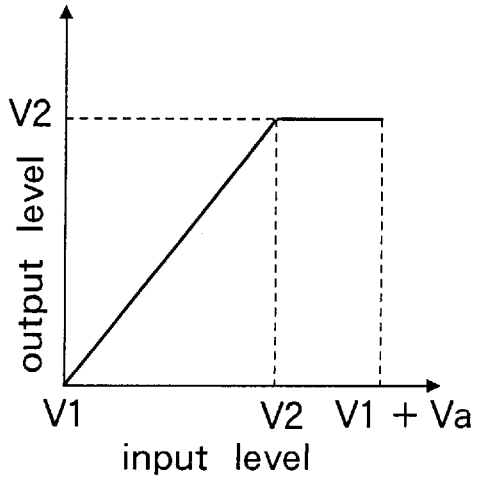
FIG. 5 is a characteristic diagram showing an input/output characteristic of a second differential amplifier in the gamma corrector shown in FIG. 3.

In the input/output characteristic of the signal in the differential amplifier 12, the gain characteristic is inflected at the reference voltage signal level V2, i.e. the first set point, at the constant voltage source V2, as shown in FIG. 5. The differential amplifier 12 has the constant current source I2 only at the side of the transistor Q3 between the transistors Q3 and Q4. This allows each of the transistors Q3 and Q4 to perform a switching operation more easily, having the reference voltage signal level V2 as an inflection point. Thus, the input/output characteristic in the differential amplifier 12 is as follows. Zero (0) or positive gain is obtained in the signal level range from V1 to V2 while, in the signal level range from V2 to V1+Va, a signal with a constant value is outputted at a gain lower than the gain obtained in the signal level range from V1 to V2.

In the input/output characteristic of the signal in the differential amplifier 13, the gain characteristic is inflected at the reference voltage signal level V2, i.e. the first set point, at the constant voltage source V2, as shown in FIG. 6. The differential amplifier 13 has the constant current source I3 only at the side of the transistor Q6 between the transistors Q5 and Q6. This allows each of transistors Q5 and Q6 to perform a switching operation more easily, having the reference voltage signal level V2 as an inflection point. Also, the circuit structure of the differential amplifier 13 is substantially symmetrical with the circuit structure of the differential amplifier 12. Thus, the input/output characteristic in the differential amplifier 13 is as follows. A signal with a constant value is outputted in the signal level range from V1 to V2, while negative gain is obtained in the signal level range from V2 to V1+Va.

In the input/output characteristic of the signal in the differential amplifier 14, the gain characteristic is inflected at the reference voltage signal level V3, i.e. the second set point, at the constant voltage source V3, as shown in FIG. 7. The differential amplifier 14 has the constant current source I4 only at the side of the transistor Q8 between the transistors Q7 and Q8. This allows each of transistors Q7 and Q8 to perform a switching operation more easily, having the reference voltage signal level V3 as an inflection point. The circuit structure of the differential amplifier 14 is substantially the same as the circuit structure of the differential amplifier 13. However, the reference voltage value, V3, at the constant voltage source V3 is set lower than the reference voltage level, V2, at the constant voltage source V2. Thus, the input/output characteristic in the differential amplifier 14 is as follows. Negative gain is obtained in the signal level range from V1 to V3, while a signal with a constant value is outputted in the signal level range from V3 to V1+Va.

Adding and mixing the output signals from the differential amplifiers 11–14 with the characteristics shown in FIGS. 4–7 produces a two-point point input/output characteristic, i.e. a gamma characteristic, in which the gain characteristic varies at two inflection points, as shown in FIG. 8.

Figures 9A, 9B:
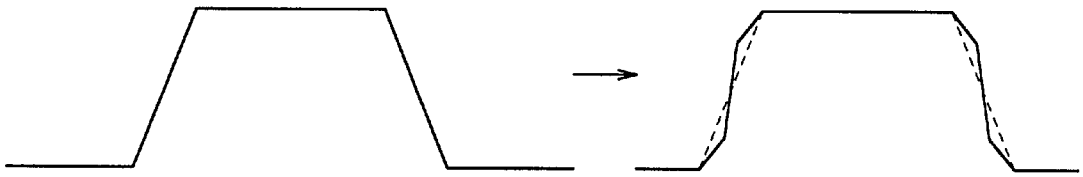
FIGS. 9A and 9B are characteristic diagrams showing in a square wave a composite input/output characteristic of. the gamma corrector shown in FIG. 3.

FIGS. 9A and 9B are characteristic diagrams showing in a square wave a composite input/output characteristic of the gamma corrector 4. If the inputted signal $S_i$ produces a square wave as shown in FIG. 9A, the gamma corrector 4 according to this embodiment applies the gamma correction to the inputted signal $S_i$ as shown in FIG. 9B. As shown in FIGS. 8, 9A and 9B, in the gamma corrector 4 according to this embodiment, the two-point gamma correction is applied to the inputted signal $S_i$ so that the signal level at the side of the black level is turned down while the signal level at the side of the white level is turned up. By such a gamma correction, the screen appears brighter and displays a sharper image, and the image quality appears higher on the screen in the CRT 3.

As described above, in the gamma corrector 4 according to this embodiment, the signal $S_i$ as an image signal is inputted to each of the differential amplifiers 11–14 which are connected in parallel to each other. Also, a plurality of output signals which are outputted from the differential amplifiers 11–14 are mixed, and thus an image signal $S_{out}$, that is an image signal to which the gamma correction has been applied, is outputted. Each of the differential amplifiers 11–14 amplifies and outputs the inputted signal $S_i$ with different gain characteristics so that the gain characteristic of the signal obtained by mixing the output signals varies at two inflection points. Thus, the two-point gamma correction is achieved in which the signal level of the inputted signal $S_i$ is turned up at the side of the black level and turned down at the side of the white level without changing the maximum voltage to be applied to the CRT 3. Accordingly, it is possible to solve the problem that the dark part appears unclear due to turning up the gray level, as found in the one-point gamma corrector of the related art. Also, a screen appears brighter and displays a sharper image, and the image quality appears higher. In addition, because the gamma corrector 4 has a simple circuit structure basically including only differential amplifiers 11–14, the frequency bandwidth, 150 MHz/−3 dB, for example, required for a display device for a computer can be obtained with a small parasitic capacity. Furthermore, placing the gamma corrector 4 in front of the preamplifier 5 and applying the gamma correction to an image signal while the amplitude of the image signal is still small can prevent a bad effect on the signal which may be caused by the gamma correction.

In this way, according to this embodiment, the optimum gamma correction for a display device such as a display device for a computer is achieved.

The invention also includes other various modifications, not limited to the embodiment above. In the embodiment described above, the gamma corrector 4 is placed in front of the preamplifier 5. However, the gamma corrector 4 may be placed behind the preamplifier 5 and the gamma correction may be applied to an output signal from the preamplifier 5. Also, the gamma corrector of the present invention may be applied to other display devices, not limited to a display device for a computer.

As described above, according to the gamma corrector of the present invention, each of the differential amplifiers amplifies the inputted image signal with different gain characteristics so that the gain characteristic of the signal obtained by mixing a plurality of output signals varies at two inflection points. Accordingly, the optimum gamma correction for a display device such as a display device for a computer is achieved.

According to the gamma corrector of one aspect of the present invention, in a display device including a main amplifier and a preamplifier, the differential amplifiers apply the gamma correction to an image signal before the image signal is inputted to the preamplifier. Accordingly, the gamma correction can be applied to the image signal while the amplitude of the image signal is still small and thus a bad effect on the signal, which may be caused by the gamma correction, can be prevented.

According to the image display device of the present invention, the gamma corrector of the present invention is provided. Accordingly, the optimum gamma correction for a display device such as a display device for a computer is achieved.

Obviously many modifications and variations of the present invention are possible in the light of the above teachings. It is therefore to be understood that within the scope of the appended claims the invention may be practiced otherwise than as specifically described.

What is claimed is:

1. A gamma corrector, comprising: an input inputting an image signal to a plurality of differential amplifiers which are connected in parallel to each other and an output mixing a plurality of output signals which are outputted from the differential amplifiers to output an image signal to which the gamma correction has been applied, wherein each of the differential amplifiers amplifies and outputs the inputted image signal with a different gain characteristic so that the gain characteristic of the signal obtained by mixing the output signals varies at two inflection points, wherein the plurality of differential amplifiers comprises:

a first differential amplifier for amplifying the image signal with a constant gain;

a second differential amplifier for amplifying the image signal with zero (0) or a positive gain when the image signal is smaller than a first set point;

a third differential amplifier for amplifying the image signal with a negative gain when the image signal is larger than the first set point; and a fourth differential amplifier for amplifying the image signal with a negative gain when the image signal is smaller than a second set point.

2. A gamma corrector according to claim 1, wherein the first differential amplifier comprises a first transistor and a second transistor, an emitter of the first transistor and an emitter of the second transistor being connected to each other through a resistance element, the image signal being inputted to a base of the first transistor, a first reference voltage being applied to a base of the second transistor, a collector of the second transistor being connected to an output terminal.

3. A gamma corrector according to claim 1, wherein the second differential amplifier comprises a third transistor and a fourth transistor, an emitter of the third transistor and an emitter of the fourth transistor being connected to each other through a resistance element, the image signal being inputted to a base of the third transistor, a second reference voltage being applied to a base of the fourth transistor, a collector of the fourth transistor being connected to an output terminal.

4. A gamma corrector according to claim 1, wherein the third differential amplifier comprises a fifth transistor and a sixth transistor, an emitter of the fifth transistor and an emitter of the sixth transistor being connected to each other through a resistance element, the image signal being inputted to a base of the fifth transistor, a second reference voltage being applied to a base of the sixth transistor, a collector of the fifth transistor being connected to an output terminal.

5. A gamma corrector according to claim 1, wherein the fourth differential amplifier comprises a seventh transistor and an eighth transistor, an emitter of the seventh transistor and an emitter of the eighth transistor being connected to each other through a resistance element, the image signal being inputted to a base of the seventh transistor, a third reference voltage being applied to a base of the eighth transistor, a collector of the seventh transistor being connected to an output terminal.

6. A gamma corrector according to claim 1, wherein the first differential amplifier comprises a first transistor and a second transistor, an emitter of the first transistor and an emitter of the second transistor being connected to each other through a resistance element, the image signal being inputted to a base of the first transistor, a first reference voltage being applied to a base of the second transistor, a collector of the second transistor being connected to an output terminal;

the second differential amplifier comprises a third transistor and a fourth transistor, an emitter of the third transistor and an emitter of the fourth transistor being connected to each other through a resistance element, the image signal being inputted to a base of the third transistor, a second reference voltage being applied to a base of the fourth transistor, a collector of the fourth transistor being connected to an output terminal;

the third differential amplifier comprises a fifth transistor and a sixth transistor, an emitter of the fifth transistor and an emitter of the sixth transistor being connected to each other through a resistance element, the image signal being inputted to a base of the fifth transistor, a second reference voltage being applied to a base of the sixth transistor, a collector of the fifth transistor being connected to an output terminal; and the fourth differential amplifier comprises a seventh transistor and an eighth transistor, an emitter of the seventh transistor and an emitter of the eighth transistor being connected to each other through a resistance element, the image signal being inputted to a base of the seventh transistor, a third reference voltage being applied to a base of the eighth transistor, a collector of the seventh transistor being connected to an output terminal.

7. A gamma corrector according to claim 6, wherein the third reference voltage is lower than the second reference voltage.

8. An image display device comprising: a gamma corrector which inputs an image signal to a plurality of differential amplifiers which are connected in parallel to each other and mixes a plurality of output signals which are outputted from the differential amplifiers to output an image signal to which the gamma correction is applied, wherein each of the differential amplifiers amplifies and outputs the inputted image signal with a different gain characteristic so that the gain characteristic of the signal obtained by mixing the output signals varies at two inflection points, wherein the differential amplifiers comprise:

a first differential amplifier for amplifying the image signal with a constant gain;

a second differential amplifier for amplifying the image signal with zero (0) or a positive gain when the image signal is smaller than a first set point;

a third differential amplifier for amplifying the image signal with a negative gain when the image signal is larger than the first set point; and a fourth differential amplifier for amplifying the image signal with a negative gain when the image signal is smaller than a second set point.

9. An image display device according to claim 8, wherein the first differential amplifier comprises a first transistor and a second transistor, an emitter of the first transistor and an emitter of the second transistor being connected to each other through a resistance element, the image signal being inputted to a base of the first transistor, a first reference voltage being applied to a base of the second transistor, a collector of the second transistor being connected to an output terminal;

the second differential amplifier comprises a third transistor and a fourth transistor, an emitter of the third transistor and an emitter of the fourth transistor being connected to each other through a resistance element, the image signal being inputted to a base of the third transistor, a second reference voltage being applied to a base of the fourth transistor, a collector of the fourth transistor being connected to an output terminal;

the third differential amplifier comprises a fifth transistor and a sixth transistor, an emitter of the fifth transistor and an emitter of the sixth transistor being connected to each other through a resistance element, the image signal being inputted to a base of the fifth transistor, a second reference voltage being applied to a base of the sixth transistor, a collector of the fifth transistor being connected to an output terminal; and the fourth differential amplifier comprises a seventh transistor and an eighth transistor, an emitter of the seventh transistor and an emitter of the eighth transistor being connected to each other through a resistance element, the image signal being inputted to a base of the seventh transistor, a third reference voltage being applied to a base of the eighth transistor, a collector of the seventh transistor being connected to an output terminal.

10. An image display device according to claim 9, wherein the third reference voltage is lower than the second reference voltage.

* * * * *

UNITED STATES PATENT AND TRADEMARK OFFICE

CERTIFICATE OF CORRECTION

PATENT NO. : 6,577,285 B1
DATED : June 10, 2003
INVENTOR(S) : Hitoshi Motonakano et al.

It is certified that error appears in the above-identified patent and that said Letters Patent is hereby corrected as shown below:

Title page,
Item [57], ABSTRACT,
Line 2, replace “the” with -- a plurality of --.
Line 5, replace “a plurality of” with -- the --.

Signed and Sealed this

Twenty-third Day of March, 2004

JON W. DUDAS
*Acting Director of the United States Patent and Trademark Office*